United States Patent [19]

Fricker

[11] 4,383,674

[45] May 17, 1983

[54] CORE BODY FOR THE RECESSED POSITIONING OF AN ANCHOR ELEMENT IN A CONCRETE MEMBER

[76] Inventor: Siegfried Fricker, Wurmbergerstrasse 30-34, 7135 Wiernsheim, Fed. Rep. of Germany

[21] Appl. No.: 308,566

[22] Filed: Oct. 5, 1981

[30] Foreign Application Priority Data

Oct. 4, 1980 [DE] Fed. Rep. of Germany ..... 3037596

[51] Int. Cl.[3] ..... B28B 7/04

[52] U.S. Cl. ..... 249/177; 249/180; 249/183; 249/184

[58] Field of Search ..... 249/177, 180, 183, 184

[56] References Cited

U.S. PATENT DOCUMENTS

| | | | |
|---|---|---|---|
| 1,970,860 | 8/1934 | Lowell | 264/69 |
| 2,366,656 | 1/1945 | Saffert | 249/142 |
| 4,063,861 | 12/1977 | Schmidt | 249/183 |
| 4,101,626 | 7/1978 | Takahashi | 249/183 |
| 4,296,909 | 10/1981 | Haeussler | 249/177 |

FOREIGN PATENT DOCUMENTS

| | | |
|---|---|---|
| 2167274 | 8/1973 | France . |
| 866164 | 4/1961 | United Kingdom . |

*Primary Examiner*—John A. Parrish
*Attorney, Agent, or Firm*—Joseph A. Geiger

[57] ABSTRACT

A core body assembly for the creation of an oblong arcuate recess in a prefabricated concrete member and for the positioning of an anchor element in the recess, the core body assembly comprising two rigid inner core body parts which are enclosed within a flexible core body jacket, forming a bending connecting bridge and an adjoining anchor retaining groove with centering protrusions in its anchor positioning flanks. The inner core body parts have attachment inserts to which the end of a threaded rod can be attached, and they tilt against each other to clamp the anchor element, when the core body assembly is clamped against the formwork.

13 Claims, 5 Drawing Figures

CORE BODY FOR THE RECESSED POSITIONING OF AN ANCHOR ELEMENT IN A CONCRETE MEMBER

BACKGROUND OF THE INVENTION

1. Field of the Invention

The present invention relates to concrete casting equipment and accessories and, more particularly, to a composite core body for the positioning of an anchor element in a prefabricated concrete member in such a way that an exposed end portion of the anchor element is positioned within an arcuate recess of the concrete member.

2. Description of the Prior Art

It is known to utilize recessed "lost anchors" for the handling of heavy prefabricated concrete members. The recessed arrangement of the anchor elements has the advantage of eliminating the need for a cutting operation on the anchor element, after the concrete member has been hoisted to its intended place in the building structure.

A hoisting attachment which features such a recessed anchor element is disclosed in U.S. Pat. No. 3,883,170. The hoisting harness includes a torus-shaped clasp-like hoisting shackle with a transverse slot and an arcuate locking bolt reaching across the slot and cooperating with an exposed eye portion of the anchor member engaged in the slot. The result is a secure connection which can be released by retracting the arcuate locking bolt of the shackle behind its transverse slot.

This hoisting attachment features an oblong arcuate recess in the concrete member to enable the torus-shaped hoisting shackle to reach over and engage the anchor element whose eye portion is arranged in the center of the recess. The casting of such a recess and the positioning of the anchor element are accomplished with the aid of a special core body which has the shape of a flattened spheroid which has been cut in half transversely. This core body encloses and holds the later exposed eye portion of the anchor element while being attached to the inside of a side plank of the formwork.

It has been found that, in order to safely attach the anchor element in a cantilever-type connection with the core body, the flanks of the core body engaging the eye portion of the anchor element must also engage the eye opening itself. This presents a problem in connection with the removal of the core body from the finished concrete member in that the release of the core body from the anchor element necessitates an opening movement on the part of these anchor positioning flanks. This problem is solved by arranging the anchor positioning flanks in the core body as opposite sides of a transverse groove which reduces the mid-portion of the core body to a thin bridge portion. This bridge portion forms a flexible hinge between two quarter-sectors of the "flattened spheroid", for the required opening displacement of the anchor positioning flanks.

The prior art suggests for the core body to be made of natural rubber or vulcanized rubber. For its attachment to the formwork, it includes at least one embedded nut which is engageable by a bolt or threaded rod. Frequently, at least one of the two anchor positioning flanks is formed by an embedded steel insert, in order to improve the cantilever-type connection for the anchor element. This steel insert includes a protrusion which fits into the eye opening of the anchor element. The opposing flank is a flat rubber face. Obviously, the use of a steel insert makes the core body more complex and therefore more expensive.

A major shortcoming of a core body of rubber is its tendency to develop brittleness as a result of aging of the rubber, especially in those portions of the core body in which it is repeatedly compressed or flexed.

SUMMARY OF THE INVENTION

Underlying the present invention is the primary objective of eliminating the aforementioned shortcomings of the prior art core bodies by suggesting an improved core body construction which, while being less expensive in production, is superior in use, having a more stable structure and an increased longevity.

The present invention proposes to attain this objective by suggesting a core body assembly which is composed of at least two comparatively rigid inner core body parts which are enveloped by a core body jacket of comparatively flexible material, the jacket having an outer shape which corresponds to the shape of the desired oblong arcuate recess. In this core body assembly is arranged a transverse anchor retaining groove which leaves only a central connecting bridge joining two sectors of the core body assembly in the vicinity of an oblong rim flange at the inner side of the core body assembly. The rim flange surrounds a flat attachment face. Because the transverse connecting bridge of the core body assembly is formed by the core body jacket only, it becomes a bending hinge for the two core body sectors.

In a preferred embodiment of the invention, the anchor retaining groove has opposing nose-like centering protrusions in the center of its anchor positioning flanks, the centering protrusions reaching into the eye aperture of the anchor element to positively position and retain the latter. The center portions of the centering protrusions are preferably formed by the inner core body parts and so shaped that they abut against each other with a tapered button in one protrusion and a matching depression in the other protrusion. All the surfaces of the anchor positioning flanks, including their centering protrusions are formed by the core body jacket, so that the eye portion of the anchor element is not in direct contact with any portions of the inner core body parts.

The preferred embodiment of the invention also features fastener means for releasably attaching the core body to a plank of the formwork, including at least one threaded nut which is embedded in one of the two inner core body parts and which is accessible through a bore by a bolt or threaded rod. In order to enhance the versatility of this core body, the invention further suggests to incorporate in the second inner core body part a bayonet lock plate for the bayonet-type attachment of a threaded rod. This core body thus lends itself for either a quick attachment with the aid of a special threaded rod which has a bayonet lock head, or for routine attachment with the aid of a length of plain threaded rod.

Also arranged in the inner core body parts are two blind bores which extend perpendicularly to the attachment face and which are lined with the flexible material of the core body jacket. These blind bores serve for the insertion of two rods which, when tilted towards each other, pivot the two sectors of the core body about its connecting bridge, thereby opening the anchor retaining groove for the insertion of the anchor element and for the later removal of the core body from the set concrete.

Lastly, the present invention suggests the arrangement of the inner core body parts in such a way that, when the core body is attached to the formwork with one or two fasteners, a lateral clamping action is exerted against the eye portion of the anchor element. This is accomplished by shaping the inner core body parts in such a way that each forms a fulcrum in the vicinity of the attachment face, at the point which is most remote from the connecting bridge and that a central portion of the connecting bridge and of the inner core body parts is recessed away from the attachment face. A clamping action by one or two fasteners causes the two inner core body parts to move against each other in a tilting displacement about their fulcrums.

The inner core body parts as well as the core body jacket are preferably molded of plastic material. Suitable materials are polyamide for the inner core body parts and polyurethane for the core body jacket, for example. The joint between the rigid inner core body parts and the flexible core body jacket can be strengthened by arranging in the inner parts suitable dovetail grooves or other undercut recesses into which the material of the core body jacket penetrates in the molding process. Also aimed at the strengthening of this joint is a suggestion that each inner core body part have at least one through-bore through which opposite wall portions of the core body jacket are joined.

BRIEF DESCRIPTION OF THE DRAWINGS

Further special features and advantages of the invention will become apparent from the description following below, when taken together with the accompanying drawings which illustrate, by way of example, an embodiment of the invention represented in the various figures as follows.

DESCRIPTION OF THE PREFERRED EMBODIMENT

Figure 1:
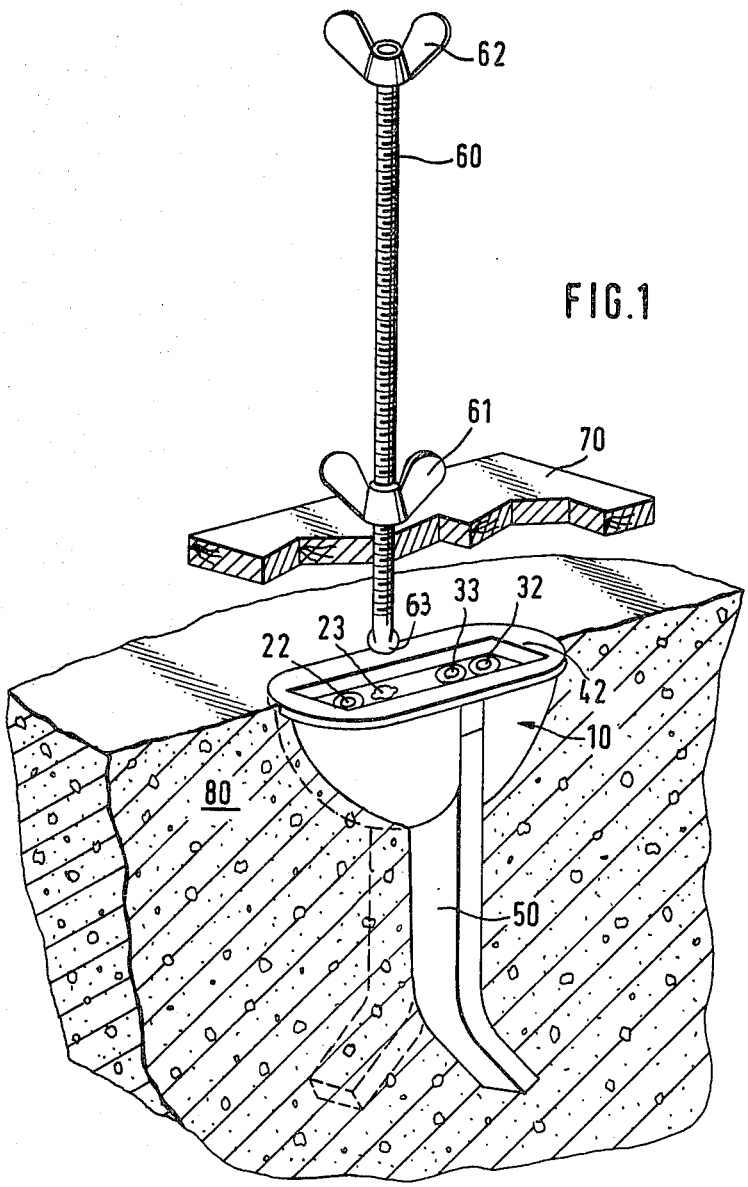
FIG. 1 shows, in a partially sectioned perspective view, a core body assembly embodying the present invention, the assembly being shown just prior to its removal from a finished concrete member.

Referring to FIG. 1 of the drawing, it can be seen that the core body assembly 10 is positioned flush with the face of a prefabricated concrete member 80, as a result of its attachment to the inner side of a formwork plank 70 which is just being removed. Serving to attach the core body assembly 10 to the plank 70 is a threaded rod 60 and a cooperating wing nut 61. A second wing nut 62 is welded to the extremity of the threaded rod 60 to serve as a rotation handle. The threaded rod 60 has at its lower end a bayonet lock head 63 with which it is attachable to a cooperating attachment insert inside the core body assembly, as will be described in more detail further below.

Figure 2:
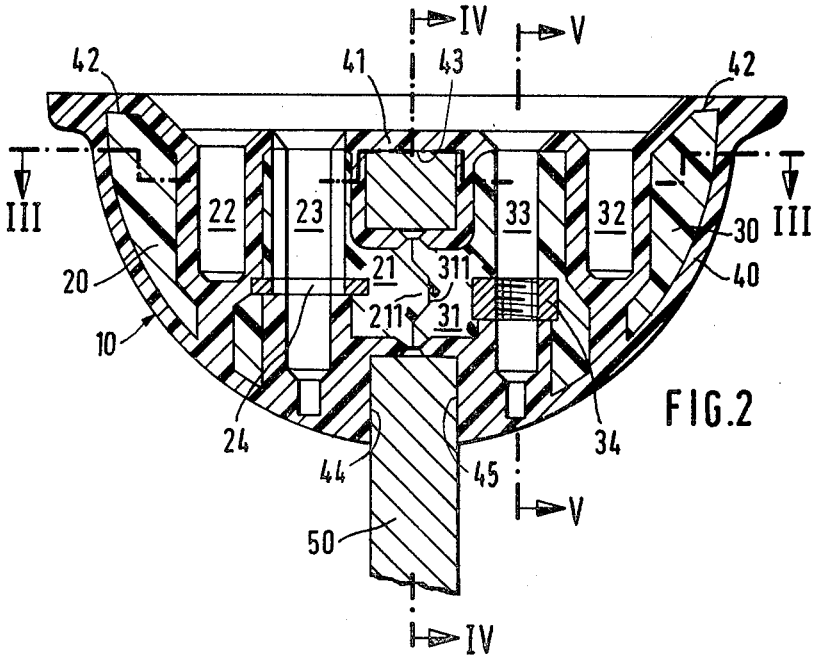
FIG. 2 shows the core body assembly of FIG. 1 and the eye portion of an attached anchor element in an enlarged longitudinal cross section, as taken along line II—II of FIG. 3.
Figure 3:
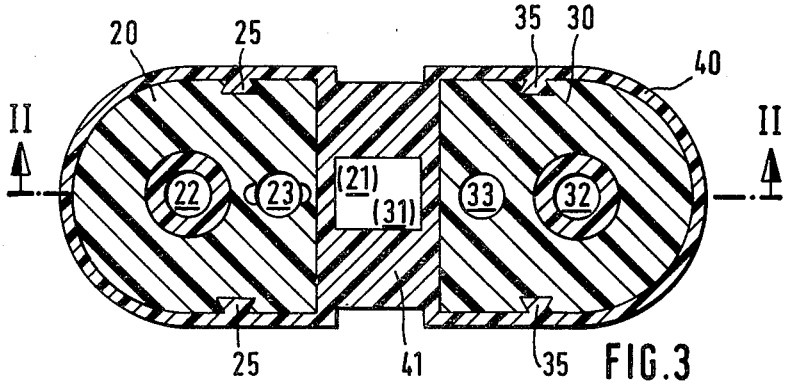
FIG. 3 shows a cross section through the assembly of FIG. 2, taken along line III—III of the latter.

As can be seen in FIGS. 2 and 3, the core body assembly consists essentially of two sector-shaped inner core body parts 20 and 30 which are enclosed within a core body jacket 40. The shape of the latter, resembling a transversely cut flattened spheroid, determines the shape of the recess which is to be produced in the concrete member 80.

The two inner core body parts 20 and 30 are spaced a distance from the center plane of the core body assembly so as to form a transverse anchor retaining groove with parallel oppositely oriented anchor positioning flanks 44 and 45. The outer side of a central connecting bridge 41 of the core body jacket 40 forms the bottom face 43 of the anchor retaining groove.

Figure 4:
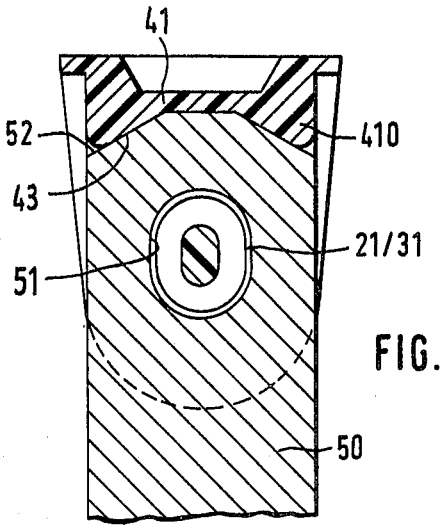
FIG. 4 shows a central transverse cross section through the assembly of FIG. 2, taken along line IV—IV of the latter.

In order to reliably position the anchor element 50 in the core body assembly 10, the latter further includes centering protrusions 21 and 31 which extend into the anchor retaining groove so as to engage the eye aperture 51 of the anchor element 50 (FIG. 4). In the example shown, the eye aperture 51 is of oblong shape and the centering protrusions 21 and 31 of the core body assembly have a matching contour.

FIG. 1 also shows that the two centering protrusions 21 and 31 abut against each other half-way between the anchor positioning flanks 44 and 45, one of the abutting protrusions having a tapered button 211 and the other having a matchingly tapered depression 311, so that the two protrusions 21 and 31 are forcibly aligned, when pressed against each other. The anchor positioning flanks 44 and 45 as well as the centering protrusions 21 and 31 are lined with wall portions of the core body jacket 40, so that only the latter touches the anchor element.

The connecting bridge 41 on the inner side of the core body assembly 10 constitutes the only connection between the two sectors of the core body assembly. It follows that, since this connecting bridge is part of the flexible core body jacket, it can serve as a bending hinge around which the two sectors of the assembly are pivotable, thereby making it possible to separate the anchor positioning flanks 44 and 45. Such a separating movement is necessary, when the eye portion of the anchor element 50 is to be inserted into the anchor retaining groove of the core body assembly, and it is again necessary, when the core body assembly is to be removed from the set concrete.

In order to facilitate the bending action on the core body assembly, especially in connection with its release from the permanently embedded anchor element, the core body assembly has arranged in it two blind bores 22 and 32. By inserting suitable rods into these two bores and by tilting the rods against each other, the two sectors of the core body assembly can be effortlessly separated to open up the anchor retaining groove.

FIG. 4 shows that the bottom 43 of the anchor retaining groove is saddle-shaped, in adaptation to a matchingly chamfered end face 52 of the anchor element 50. This shape has the advantage of providing reinforced edge portions 410 on the connecting bridge 41 while at the same time improving the anchor positioning capability of the core body assembly.

Both the inner core body parts 20 and 30 and the core body jacket 40 are produced and assembled in injection molding operations, the core body jacket being cast around the two inner parts. It has been found that polyamide is a suitably rigid material for the inner core body parts 20 and 30, while polyurethane or a soft PVC will provide the necessary flexibility for the core body jacket. In order to produce a reliable interface connection between the rigid inner core body parts 20 and 30 and the flexible core body jacket 40, FIG. 3 suggests the arrangement of several dovetailed grooves 25 and 35 in the inner core body parts 20 and 30, respectively, so that the material of the core body jacket 40, by penetrating into these grooves, produces a permanent connection.

An additional attachment is obtained by arranging the blind bores 22 and 32 in the core body assembly in such a way that they, too, are lined with wall portions of the core body jacket 40. These wall portions, while defining the actual diameter and depth of the blind bores 22 and 23, provide connections between the inner and outer sides of the core body jacket 40.

In order to create the desired oblong arcuate recess in a concrete face and in order to correctly position the anchor element so that its eye portion protrudes into the center of the recess, the core body assembly 10 is first attached to the anchor element 50 in the manner described above, whereupon the assembly 10 is clamped to the inner side of plank 70 of the concrete casting formwork. As stated earlier, this clamping action is achieved with the aid of one or two threaded rods 60, a single threaded rod being sufficient in most cases.

Figure 5:
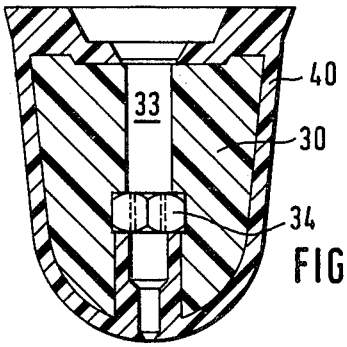
FIG. 5 shows another transverse cross section of the assembly of FIG. 2, taken along line V—V of the latter.

For this purpose, the inner core body parts 20 and 30 have embedded in them two attachment inserts. The core body part 30 carries in its outer portion a threaded nut 34 which retains an end portion of a length of threaded rod (not shown), while a clamping action is applied to the rod by means of a wing nut like the wing nut 61 of FIG. 1. The arrangement of the threaded nut 34 in the outer portion of part 30 assures that the clamping force from the threaded rod is safely transmitted into the core body part 30. As can be seen in FIG. 5, the bore portion on the outer side of the nut 34 is lined with wall portions of the core body jacket 40 to form a smaller diameter than the bore 33, thus providing a frictional engagement between the compressible material of the core body jacket 40 and the extremity of the threaded rod.

In FIG. 1 is shown a modified threaded rod 60 which has a formed extremity 63 adapted for cooperation with a bayonet lock plate 24 which is embedded in the inner core body part 20. Functionally, the plate 24 takes the place of the threaded nut 34. It should be understood that, instead of having a bayonet lock plate in one inner core body part and a threaded nut in the other for optimal versatility, the core body assembly could also have just two threaded nuts or two lock plates.

The bayonet lock head 63 of the threaded rod 60 is insertable through the bore 23 and the plate 24 and, after a quarter-turn, becomes locked against the plate 24, for a quick and reliable connection between the threaded rod 60 and the part 20. Such a bayonet lock is generally less susceptible to the presence of foreign matter in the bore 23. A more detailed description of this bayonet lock configuration is provided in my copending U.S. patent application, Ser. No. 308,567, filed Oct. 5, 1981.

The tightening of the wing nut 61 on the threaded rod 60, besides producing a clamping action between the inner core body part 20 or 30 and the plank 70, also produces a transverse clamping action between the two core body parts 20 and 30 and the anchor element 50 engaged between their anchor positioning flanks 44 and 45. This clamping action assures that the anchor element 50 cannot shift out of place in the course of the concrete casting operation.

The centering configuration between the protrusions 21 and 31 of the inner core body parts 20 and 30 also assures that, even in the case where only one threaded rod is utilized, both core body parts execute substantially the same pivoting displacement about their fulcrums 42 to provide the anchor clamping action. This clamping displacement has the additional advantage of jamming the end face 52 of the anchor element against the connecting bridge 41 of the core body jacket 40 (FIG. 4), for an optimal engagement between the core body assembly 10 and the anchor element 50.

The configuration of the novel composite core body assembly combines in it the advantages of a rigid body, in terms of its capability of firmly clamping the anchor element 50, with the advantages of a flexible body, in terms of its capability of providing a bending hinge at the connecting bridge 41 and assuring the safe clamping and positioning of anchor elements which may vary somewhat in their dimensions. Furthermore, the configuration is such that only the core body jacket 40 is in contact with the concrete mass and with the formwork. The polyurethane material of the jacket provides assurance that the core body is not damaged by chemical or physical action of the concrete, or through contact with the formwork which may have been treated with protective oil.

It should be understood, of course, that the foregoing disclosure describes only a preferred embodiment of the invention and that it is intended to cover all changes and modifications of this example of the invention which fall within the scope of the appended claims.

I claim the following:

1. A core body assembly for the creation of an oblong arcuate recess in a face of a prefabricated concrete member and for the simultaneous positioning of an embedded anchor element in such a way that an eye portion of the anchor element is located in the center of said recess and below said face, the core body assembly comprising in combination:

two inner core body parts of a combined shape which is similar in outline but smaller in dimensions than the shape of the desired recess, the inner core body parts being molded of a comparatively rigid and resistant material;

a core body jacket enveloping substantially all surface portions of the inner core body parts, the core body jacket being molded of a comparatively flexible material, having an outer shape which represents the spatial negative of the desired reress; and means for releasably attaching the core body assembly to a formwork surface in such a way that a clamping action is exerted between the formwork and at least one of the inner core body parts; and wherein the core body jacket has an oblong rim defining the outline of a flat attachment face on the inner side of the core body assembly;

the core body jacket further forms a transverse connecting bridge in the vicinity of the attachment face, the connecting bridge serving as a bending hinge between two halves of the core body assembly which envelop the two inner core body parts;

the core body assembly forms a transverse anchor retaining groove of which the outer side of the connecting bridge constitutes the bottom, the anchor retaining groove having opposing anchor positioning flanks; and the anchor positioning groove includes means for positively positioning and clamping the eye portion of an anchor element when the core body assembly is attached to a formwork surface.

2. A core body assembly as defined in claim 1, wherein the outer shape of the core body jacket resembles that of a transversely halved flattened spheroid which is subdivided by the anchor retaining groove into two quarter-spheroids; and the two inner core body parts likewise resemble two quarter-spheroids, being substantially identical in shape and enveloped on all sides by the core body jacket.

3. A core body assembly as defined in claim 1, wherein the inner core body parts have dovetail-shaped grooves engaged by the material of the core body jacket so as to form a mechanical connection therebetween.

4. A core body assembly as defined in claim 1, wherein at least one inner core body part has a through-bore oriented transversely to the attachment face of the core body assembly; and the core body jacket has a wall portion extending the length of the through-bore so as to form a connection between opposite outer wall portions of the core body jacket.

5. A core body assembly as defined in one of claims 1 through 4, wherein the anchor element positioning and clamping means of the anchor positioning groove includes centering protrusions adapted to engage the eye opening of the anchor element, the centering protrusions being portions of the inner core body parts, extending in opposite directions from the anchor positioning flanks and abutting against one another in the attached position of the core body assembly; and the centering protrusions include protrusion alignment means which align the protrusions in their abutted position.

6. A core body assembly as defined in claim 5, wherein the alignment means of the centering protrusions include a tapered button on one centering protrusion and a matching recess in the other centering protrusion.

7. A core body assembly as defined in any one of claims 1 through 4, wherein the means for attaching the core body assembly includes, in at least one of the inner core body parts, an attachment insert which is accessible through a bore oriented perpendicularly to the attachment face of the core body assembly; and said means further includes a clamping member which is insertable into the core body assembly and releasably connectable to its attachment insert.

8. A core body assembly as defined in claim 7, wherein the attachment insert is a threaded nut and the clamping member is a threaded fastener.

9. A core body assembly as defined in claim 7, wherein the attachment insert is a bayonet lock plate with a non-circular bore; and the clamping member is a threaded fastener having on one extremity a matchingly non-circular bayonet lock head with which it can reach through and engage the bayonet lock plate from behind.

10. A core body assembly as defined in claim 7, wherein the means for attaching the core body assembly includes an attachment insert in each of the two inner core body parts, on opposite sides of the connecting bridge;

both attachment inserts are located at a distance from the attachment face of the core body assembly, and the access bores for the attachment inserts are located in the vicinity of the connecting bridge;

one attachment insert is a threaded nut and the cooperating clamping member is a threaded fastener; and the other attachment insert is a bayonet lock plate with a non-circular bore cooperating with a threaded fastener having on one extremity a matchingly non-circular bayonet lock head.

11. A core body assembly as defined in any one of claims 1 through 4, wherein each of the two inner core body parts has a fulcrum in the form of an elevated corner portion at the edge which is most distant from the connecting bridge, the corner portion having a minimal thickness of the core body jacked interposed between it and the core body attachment face; and the means for attaching the core body assembly to the formwork includes an attachment insert in at least one of the inner core body parts and a cooperating threaded fastener extending perpendicularly to the attachment face between the location of the fulcrum and the connecting bridge, so that a tightening action on the threaded fastener will cause said inner core body part to tilt about its fulcrum and to displace the associated anchor positioning flank in the direction of the opposing anchor positioning flank.

12. A core body assembly as defined in claim 11, wherein at least a portion of the connecting bridge is recessed a short distance from the attachment face; and the bottom of the anchor retaining groove has a saddle-shaped outline in the longitudinal sense, with the result that the connecting bridge has reinforced wall portions on both ends of the anchor retaining groove.

13. A core body assembly as defined in claim 1, wherein the inner core body parts are molded of polyamide plastic and the core body jacket is molded of polyurethane plastic.

* * * * *